United States Patent [19]

Douglas et al.

[11] 3,962,045

[45] June 8, 1976

[54] APPARATUS FOR PYROLYSIS OF DOMESTIC AND OTHER WASTE MATERIALS

[75] Inventors: Edward Douglas, Welwyn; Terence Walsh, Hitchin, both of England

[73] Assignee: National Research Development Corporation, London, England

[22] Filed: Aug. 28, 1974

[21] Appl. No.: 501,440

[30] Foreign Application Priority Data

Sept. 7, 1973 United Kingdom ..... 42223/73

[52] U.S. Cl. ..... 202/117; 201/25; 201/37; 202/125; 48/111

[51] Int. Cl.[2] ..... C10B 57/04; C10B 1/04

[58] Field of Search ..... 202/117, 108, 120–125; 201/13, 14, 20, 43, 28, 29, 25, 36, 37; 48/111; 34/165, 168, 169; 110/8 R

[56] References Cited

UNITED STATES PATENTS

| | | | |
|---|---|---|---|
| 2,015,336 | 9/1935 | Bunce | 201/43 X |
| 2,448,223 | 8/1948 | Lantz | 201/29 |
| 2,698,283 | 12/1954 | Dalin | 201/43 X |
| 2,825,679 | 3/1958 | Baum | 202/108 X |
| 3,150,063 | 9/1964 | Comte | 202/120 |
| 3,829,558 | 8/1974 | Banks et al. | 201/25 X |

*Primary Examiner*—James H. Tayman, Jr.
*Attorney, Agent, or Firm*—Cushman, Darby & Cushman

[57] ABSTRACT

A pyrolysing vessel in which the inlets and outlets for the charge and the pyrolysing gas are so arranged that charge and gas pass through the vessel along paths that meet substantially at right angles. The charge may descend vertically, and the vessel may taper outwardly and downwardly to aid this descent. The gas may enter and leave the vessel through grilles that can be oscillated to further aid the descent. Pyrolysing plant including the vessel may include means to take a fraction of the gas at the outlet and recycle it through a heater to the gas inlet.

4 Claims, 2 Drawing Figures

Figure 1:
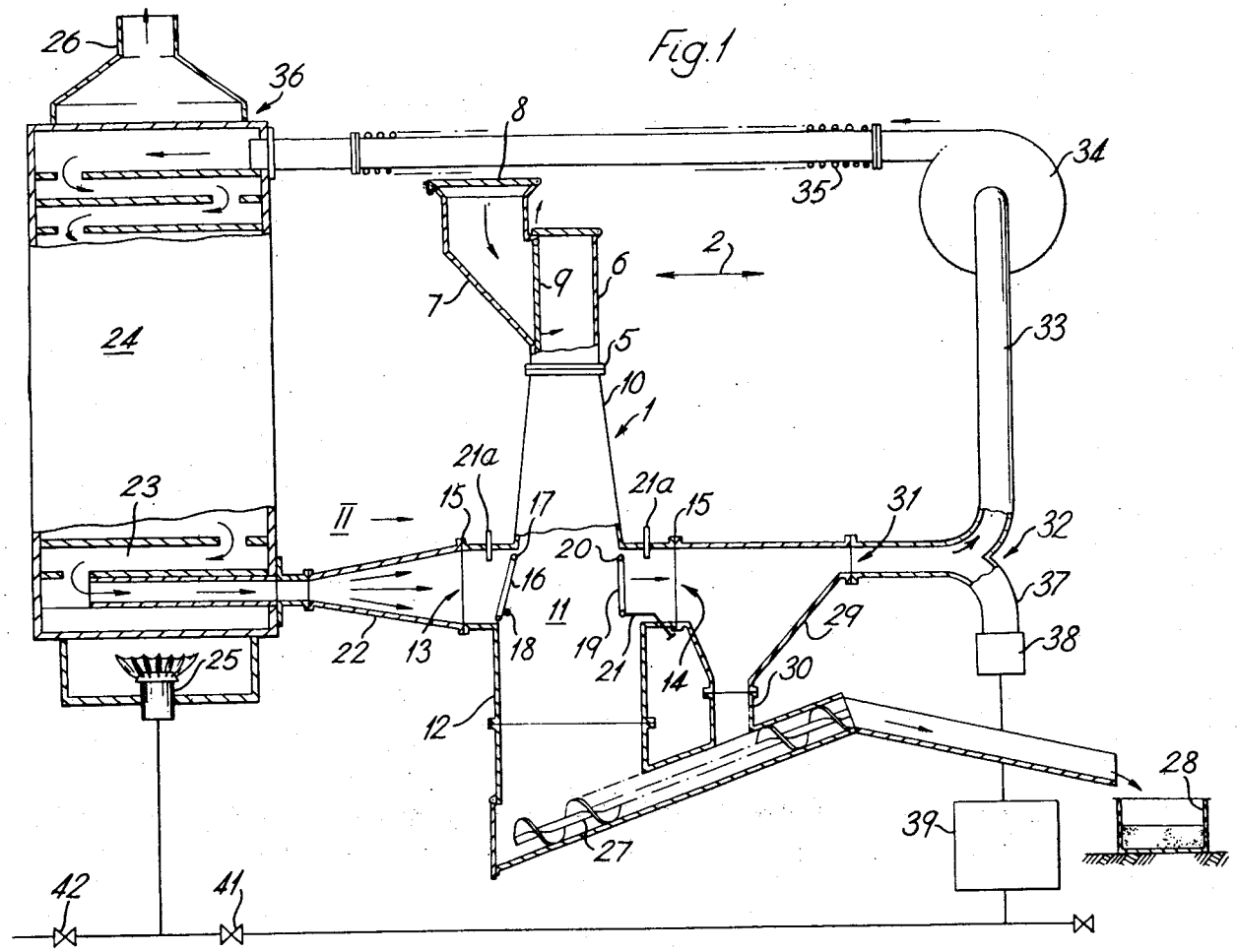

1
2
5
6
7
8
9
10
11
12
13
14
15
16
17
18
19
20
21
21a
22
23
24
25
26
27
28
29
30
31
32
33
34
35
36
37
38
39
41
42
II

APPARATUS FOR PYROLYSIS OF DOMESTIC AND OTHER WASTE MATERIALS

This invention relates to the pyrolysis of domestic and other waste materials. By pyrolysis we mean heating those materials in the absence of any substantial quantity of air or other oxidising agent, so as to break them down chemically into more acceptable gaseous, liquid or solid products. In principle the invention is applicable to a wide range of combustible wastes, including particularly garbage, other domestic refuse, sewage sludge, plastics and rubber.

Pyrolysis as a technique is already known and has been proposed for many uses. However, many such uses suffer from the disadvantage that the materials to be treated have low thermal conductivity. This tends to lead either to low treatment rates or to the need for much heat input, for which the cost of conventional fuels would be great. In one well-known type of pyrolysis technique, for instance, of which there are many examples, the materials are treated by heating a suitable gas and then passing it through the vessel in counter-current flow to the raw material. This technique has met with some success. However, in such apparatus relatively high gas velocities and a considerable head of pressure are needed to force sufficient hot gases through the material.

The present invention involves a new design of pyrolysing vessel and the use of it to pyrolyse wastes by mixing them with hot gases in a new way. Such a vessel may be of elongated shape with an inlet for raw material at one end and an outlet for pyrolysed material at the other, and an inlet for the entry of pyrolysing gas in one of its long walls and an outlet for the gas in an opposite wall, whereby the waste material and the gas may travel along intersecting paths which lie substantially at right angles to each other and meet within the vessel.

The vessel may be of narrow rectangular cross-section, the grates lying in the wider sides of the rectangle. The vessel may also be arranged so that the waste materials fall vertically through it while the gas travels horizontally, and the inlet end of the vessel may be connected to a hopper for raw material by means of a gas lock, e.g. of double-flap type, and may have similar or other suitable means for excluding air or other oxidising gases at the outlet end.

The gas outlet and inlet may be arranged so that at least a fraction of the gaseous products of pyrolysis, escaping from the vessel by way of the outlet, may be heated and re-cycled to the inlet to effect the pyrolysis of a subsequent charge of material.

Grates at the gas inlet and outlet can be movable to assist refuse flow, e.g. pivoted at the top and canted to provide a divergent chamber, or mounted on driven eccentrics to provide a positive feed of the waste through the space between the grates.

Figure 2:
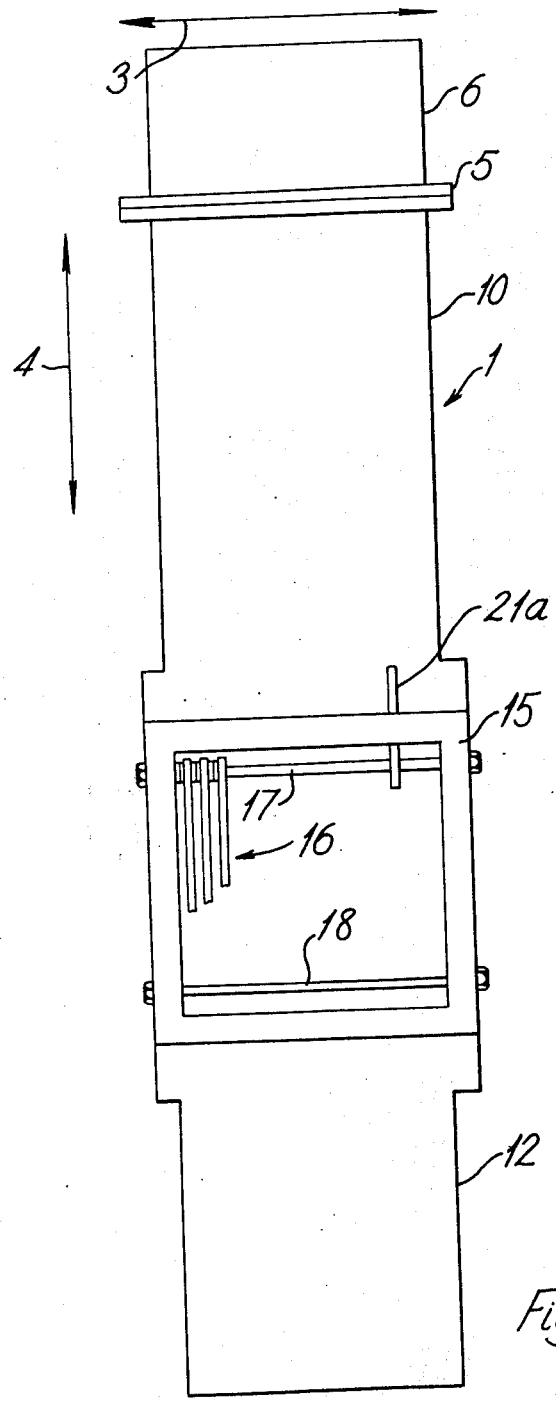

The invention is defined by the claims at the end of this specification and will now be described, by way of example, with reference to the accompanying drawings in which:

FIG. 1 is a flow diagram of a pyrolysis plant showing the pyrolysing vessel diagrammatically in sectioned side elevation, and FIG. 2 is a view of the pyrolysing vessel taken in the direction of the arrow II in FIG. 1.

Reference 1 denotes the pyrolysing vessel, and arrows 2, 3 and 4 indicate the three dimensions of that vessel that will be referred to as the depth, width and height. Flanges 5 connect the top of the vessel to ducting 6 leading in turn to a hopper 7. Raw materials for pyrolysis are delivered to the hopper, and reach the vessel 1 by way of ducting 6 and flap valves 8 and 9 which ensure that a minimum of air or other oxidising gas enters the vessel by way of the hopper and the ducting.

Vessel 1 is of rectangular cross-section from top to bottom and comprises an upper part 10, of which the depth dimension increases from top to bottom, a central furnace part 11 of constant depth where the pyrolysing takes place, and an openended lower part 12 of constant depth. The central furnace part 11 has an inlet 13 and outlet 14, horizontally aligned with each other and each carrying a flange 15 which engages with corresponding flanges on adjacent parts in a manner shortly to be described. Within part 11 an inlet grate 16 hangs freely on a horizontal pivot rod 17 and is restrained by a stop bar 18 from swinging freely to a more vertical position than is shown in FIG. 1. A similar outlet grate 19 swings freely from a pivot rod 20 and is connected to a riddling bar 21. Pressure tappings flap valve are mounted in part 11 so that gas pressure just upstream of inlet grate 16 and just downstream of outlet grate 19 may easily be determined. In operation, raw material passes by way of flapvalve 8 into hopper 7, through flap valve 9 into ducting 6 and thence through part 10 into the space between grates 16 and 19 in part 11 where it is pyrolysed by being exposed to a stream of hot gas which enters part 11 through inlet 13 and leaves through outlet 14. The solid products of pyrolysis leave vessel 1 by way of the open bottom of part 12. Thus it will be seen that material and gas travel through the vessel along intersecting paths that lie at right angles to each other, each path extending between an inlet and an outlet formed in the walls of the vessel. Thus the material travels a downward vertical path between inlet valve 9 and an outlet constituted by the open bottom end of part 12 at the opposite end of the vessel, and the gas travels a horizontal path between inlet 13 and outlet 14 situated opposite each other in parts of the wall of the vessel corresponding to opposite sides of the rectangular cross-section.

Flange 15 on inlet 13 is connected to a similar flange on an airtight funnel-shaped end 22 of a tortuous gas pipe 23 leading through a heat exchanger 24 heated by a burner unit 25 and having an upper outlet 26 for the combustion products of the burner.

In an alternative design these combustion products could be used, for instance, to dry the incoming raw material. The open bottom end of lower part 12 leads to a spiral conveyor 27 and thence to a char container 28. Flange 15 of outlet 14 connects with a similar flange on an airtight funnel 29 having a gravity outlet 30 by which settled dust may pass to conveyor 27, and a gas outlet 31 by which the gaseous products of pyrolysis pass to a branch member 32. Here a fraction of the gaseous products passes through a pipe 33 to a hot gas fan unit 34 and thence via lagged pipes 35 to the inlet 36 of the pipe 23 within heat exchanger 24. Gases passing to the other branch 37 of member 32 pass through a valve 38 to a condenser/store 39. The condensed gas within store 39 may have a typical calorific value of 350–500 Btu/cu.ft. when produced by the pyrolysis of domestic waste, and may be drawn off by way of valved outlet 40 for uses unconnected with the pyrolysis process. It may also be drawn off through valve 41 to feed burner unit 25.

Alternatively with a suitably clean gas product the burner gas could be drawn off prior to condenser 39, thus conserving its high heat content and increasing overall efficiency. Should store 39 be unable to supply sufficient gas for this purpose, or indeed to supply any of the gas required (e.g. when the plant is first brought into use) natural gas may be supplied to the burner by way of valve 42. The design just described facilitates large gas entry and exit to the pyrolysing zone of vessel 1 through grates 16 and 19, and of course the gravity feed of waste material through vessel 1 helps to maintain consistency of the charge of material.

Movement of riddling bar 21 moves outlet grate 19 so as to disturb the charge of raw material should it tend to jam between the two grates. As an alternative to bar 21, grate 19 could be mounted on eccentrics top and bottom, and inlet grate 16 could be movably mounted also. Such an arrangement could help positively to feed the raw material through furnace part 11. Steam cooling or water spraying could if necessary be used to cool the solid products emerging from lower part 12 before they alight on conveyor 27. Alternatives to such a conveyor include a chain-drive rake, in which case a water trap might be the most suitable means of cooling the charge if required.

It has been proposed that one plant, as illustrated in the drawings, could be designed to operate under slight pressure ½ inch – 2 inch wg) at a gas inlet temperature of about 700°C at grate 16 and a gas outlet temperature of about 600°C at grate 19. A typical maximum gas/-refuse rate would be 10:1 by weight, that is to say 10-lb of gas circulated for every 1 lb of raw refuse pyrolysed. For a system treating 180 lb. of raw refuse per hour the fan unit 34 should desirably be capable of handling up to 10,000 cu.ft. of gas per minute. For delivery at a temperature of 450°C and a pressure of 16 in.wg., this size of fan unit has been calculated as sufficient to achieve a miximum gas flow of about 72,000 cu.ft. per hour at 600°C across grates 16 and 19, the pressure drop across the charge between them being not greater than 3 in.wg. and generally less than 1 in.wg. To match these quantities, heat exchanger 24 should be capable of maximum heat exchange of about 450,000 Btu/hr, which would involve 450 sq.ft. tube area of gas pipe 23; this might be provided by thirty tubes, each 3 inches in diameter and 20 feet long. In one vessel according to the drawings that has already been tested, grates 16 and 19 each measured 1 foot square, and the depth of the space between them was also approximately one foot. Upper part 10 had a cross-section measuring about 11 × 12 inches at its top and one foot square at its base and lower part 12 had a constant cross-section of about 12 × 20 inches over its full height. From flanges 5 to the open bottom of lower part 12, the total height of the vessel was about 4 feet. Grates 16 and 19 were cast in steel, and the side walls of furnace part 11 were manufactured in cast steel and faced with refractory-lined cheek plates. It was found that such a vessel, operating at temperatures of 600° – 700°C as already described, could possibly treat 100–200 lbs of typical domestic refuse per hour and required a throughput of between 500–1800 lbs of gas. Of course, treatment rates vary according to the chosen gas temperatures and the rate at which gas is recirculated through fan unit 34 and heat exchanger 24.

It will readily be seen that by separating the paths of the gas and the material so that they cross, instead of coinciding in the known way, the resistance offered by the material to the gas flow becomes less dependent upon the length of the material path. Thus in the example just described the length of the material path was 4 feet but the length of the gas path, i.e. the depth of the vessel between inlet 12 and outlet 14, was only about 12 inches. The gas path could if desired be made even shorter without altering the material path, although without compensating changes this would of course diminish the cross-sectional area of the vessel and thus restrict the flow of material through it, and also diminish the amount of heat transferred from the hot gases to the material. It will also be apparent that although the vessel of this invention has been described with reference to pyrolysis, a process in which material is heated in the absence of any substantial quantity of air, the invention also includes furnaces or like vessels having the structure recited in the appropriate claims of this specification and that may be suitable for a wider range of heat exchange processes in which air may not be so absent, but in which heat exchange takes place between moving streams of hot gas and relatively cold material that meet, substantially at right angles, within the vessel.

We claim:

1. A vessel for the pyrolysis treatment of waste materials such as garbage or other domestic refuse, sewage sludge, plastics and rubber and having:

a first inlet for said waste materials in a first part of the wall of said vessel;

a first outlet for said waste materials after treatment in a second and opposite part of the wall of said vessel;

said vessel walls defining between said first inlet and outlet a first path for the progress of said material through said vessel;

the cross-section of said first path being of at least undiminishing area on proceeding along said first path from said first inlet to said first outlet;

a second inlet for hot gas to effect said pyrolysis including a first grate mounted in said vessel wall;

said second inlet being located in a third part of said vessel wall;

a second outlet for spent gas including a-second grate mounted in a fourth part of said vessel wall opposite said third part;

said second inlet and second outlet constituting the ends of a second path for the progress of pyrolysing gas through said vessel, the cross-sectional area of said first path being of increasing cross-sectional area at least from said first inlet to the region at the intersection of said first and second paths;

said first and second paths lying substantially at right angles to each other and intersecting within said vessel, and riddling means located for contacting said material travelling along said first path, and for disturbing said material travelling along said first path so that it may resume travel after jamming including means for mounting at least one of said grates for oscillatory movement relative to the material travelling along said first path and means for oscillating the grate mounted for oscillatory movement.

2. A vessel according to claim 1, wherein said first path lies vertical, whereby said material may descend under gravity along said first path, and said second path lies horizontal.

3. A vessel as in claim 1 further including, a heater, storage means, connected to said second outlet, for the gaseous products of pyrolysis, and means connecting said second outlet to said heater, whereby at least some of the gaseous products of pyrolysis may be re-cycled by way of said heater to said second inlet, whereby to contribute to the pyrolysis of further material.

4. A vessel according to claim 1 in which said first path is of substantially constant cross-sectional area from said region to said first outlet.

* * * * *

UNITED STATES PATENT OFFICE

CERTIFICATE OF CORRECTION

PATENT NO. 3,962,045

DATED June 8, 1976

INVENTOR(S) : Edward Douglas and Terence Walsh

It is certified that error appears in the above-identified patent and that said Letters Patent are hereby corrected as shown below:

Column 2, lines 25 - 26, for "flap valve" read --21a--

Column 3, line 65, for "500" read --540--

Signed and Sealed this

Nineteenth Day of October 1976

[SEAL]

*Attest:*

RUTH C. MASON
*Attesting Officer*

C. MARSHALL DANN
*Commissioner of Patents and Trademarks*